US009255577B2

(12) United States Patent
Zhai et al.

(10) Patent No.: US 9,255,577 B2
(45) Date of Patent: Feb. 9, 2016

(54) LARGE-SCALE SUBMERSIBLE SEWAGE PUMP

(75) Inventors: Songmao Zhai, Zhejiang (CN); Quanmin Li, Zhejiang (CN); Jianguo Ying, Zhejiang (CN); Zhilong Lin, Zhejiang (CN); Jun Jing, Zhejiang (CN); Kangle Teng, Zhejiang (CN)

(73) Assignee: NINGBO JUSHEN PUMPS INDUSTRY CO., LTD., Ningbo (CN)

( * ) Notice: Subject to any disclaimer, the term of this patent is extended or adjusted under 35 U.S.C. 154(b) by 129 days.

(21) Appl. No.: 13/822,085

(22) PCT Filed: Nov. 15, 2011

(86) PCT No.: PCT/CN2011/082197

§ 371 (c)(1),
(2), (4) Date: Mar. 11, 2013

(87) PCT Pub. No.: WO2012/129910

PCT Pub. Date: Oct. 4, 2012

(65) Prior Publication Data

US 2014/0010683 A1 Jan. 9, 2014

(30) Foreign Application Priority Data

Mar. 31, 2011 (CN) ..... 2011-10086723

(51) Int. Cl.

| | |
|---|---|
| ***F04D 13/02*** | (2006.01) |
| ***F04D 13/08*** | (2006.01) |
| ***F04D 29/58*** | (2006.01) |
| ***F04D 29/60*** | (2006.01) |
| ***F04D 13/06*** | (2006.01) |

(52) U.S. Cl.

CPC ..... *F04D 13/06* (2013.01); *F04D 13/086* (2013.01); *F04D 29/588* (2013.01); *F04D 29/606* (2013.01); *F04D 29/607* (2013.01)

(58) Field of Classification Search

CPC ... F04D 13/08; F04D 13/086; F04D 29/5806; F04D 29/586

USPC ..... 417/360, 423.3, 366, 367, 368

See application file for complete search history.

(56) References Cited

U.S. PATENT DOCUMENTS

| | | | | | |
|---|---|---|---|---|---|
| 3,153,382 | A | * | 10/1964 | Blarcom, Jr. | 417/423.3 |
| 3,234,885 | A | * | 2/1966 | Englesson | 415/126 |
| 3,371,613 | A | * | 3/1968 | Adolf et al. | 417/368 |
| 3,635,606 | A | * | 1/1972 | Blum | 417/360 |
| 3,653,785 | A | * | 4/1972 | Dahlgren et al. | 417/367 |
| 3,659,964 | A | * | 5/1972 | Dahlgren | 417/360 |

(Continued)

FOREIGN PATENT DOCUMENTS

JP H07119683 * 9/1995

*Primary Examiner* — Alexander Comley

(74) *Attorney, Agent, or Firm* — Gokalp Bayramoglu

(57) ABSTRACT

Disclosed is a large-scale submersible sewage pump assembly that includes a pump and a pump seat installation structure, wherein the pump seat installation structure has a concrete installation base layer, and a pump seat for installing the pump. The pump seat is fixed to the pump installation layer, and the bottom of the pump is directly connected onto the pump seat. The pump has a motor cooling apparatus, wherein the cooling apparatus has an internal cooling apparatus installed inside the case of the motor, and an external cooling apparatus installed outside the motor. The pump seat installation structure can stably mount and support the large-scale submersible sewage pump, preventing potential safety hazard during running of the pump.

7 Claims, 5 Drawing Sheets

(56) References Cited

U.S. PATENT DOCUMENTS 3,722,757 A * 3/1973 Dahlgren ..... 222/385
3,743,447 A * 7/1973 Lynch ..... 417/360
3,748,066 A * 7/1973 Sully et al. ..... 417/423.3
3,771,914 A * 11/1973 Crespo ..... 417/360
3,771,915 A * 11/1973 Back ..... 417/360
3,822,967 A * 7/1974 Cade et al. ..... 417/368
3,880,553 A * 4/1975 Wolford et al. ..... 417/360
3,938,545 A * 2/1976 Nagy et al. ..... 137/363
3,993,416 A * 11/1976 Kato ..... F04D 13/0653 417/360
4,134,711 A * 1/1979 Ivins et al. ..... 417/370
4,308,000 A * 12/1981 Oakes ..... 417/360
4,411,599 A * 10/1983 Kessel ..... E03F 5/16 417/301
RE31,445 E * 11/1983 Carter ..... F04D 9/00 222/333
4,632,643 A * 12/1986 Nielsen ..... 417/367
4,661,047 A * 4/1987 Weis ..... 417/360
4,726,742 A * 2/1988 Harbison et al. ..... 417/360
4,886,426 A * 12/1989 Surinak ..... 417/360
5,030,346 A * 7/1991 McEwen ..... 210/258
5,250,863 A * 10/1993 Brandt ..... 310/54
5,494,413 A * 2/1996 Campen ..... F04D 3/005 417/356
5,507,628 A * 4/1996 Masse et al. ..... 417/360
5,529,462 A * 6/1996 Hawes ..... 417/360
5,571,001 A * 11/1996 Fukuda et al. ..... 417/423.3
5,616,973 A * 4/1997 Khazanov et al. ..... 310/54
5,902,158 A * 5/1999 Nakase ..... F02B 61/045 144/55.5
5,906,479 A * 5/1999 Hawes ..... 417/360
5,934,872 A * 8/1999 Yamauchi ..... B60S 1/481 415/146
6,120,261 A * 9/2000 Al-Towailib ..... F04D 13/10 417/356
6,260,004 B1 * 7/2001 Hays ..... G05B 23/0235 702/130
6,322,332 B1 * 11/2001 Jensen et al. ..... 417/372
6,327,994 B1 * 12/2001 Labrador ..... B01D 61/10 114/382
6,523,498 B1 * 2/2003 Shyu ..... A01K 63/047 119/259
6,631,732 B1 * 10/2003 Koster ..... C12G 1/0216 137/571
7,131,330 B2 * 11/2006 Gurega ..... 73/306
7,264,449 B1 * 9/2007 Harned et al. ..... 417/36
7,534,098 B2 * 5/2009 Stirling et al. ..... 417/423.15
2001/0026760 A1 * 10/2001 Kleppner ..... F02M 37/025 417/84
2006/0216166 A1 * 9/2006 Pawellek ..... F01P 5/10 417/371
2008/0283101 A1 * 11/2008 Pardini ..... A47L 15/4225 134/174

* cited by examiner

LARGE-SCALE SUBMERSIBLE SEWAGE PUMP

RELATED APPLICATIONS

The present application is a National Phase of PCT/CN2011/082187, filed Nov. 15, 2011 and is based on, and claims priority from, Chinese Application No. 2011-10086723.4, filed Mar. 31, 2011.

FIELD OF THE INVENTION

The present invention relates to a large-scale submersible sewage pump.

BACKGROUND OF THE INVENTION

Presently, both the power of motor and the outflow aperture of the submersible sewage pump is poor, that is to say, the power is generally less than 400 kw and the outflow aperture is generally below 800 mm. Such submersible sewage pump is assembled in a conventional suspension way, that is to say, the side of the submersible sewage pump is fixed on one side of the elbow base at the bottom of the pool by means of a suspension unit, and thus the bottom of the pump is suspended with the bottom of the pool. However, the whole weight of a large-scale submersible sewage pump, is which generally means the submersible sewage pump with the powder more than 400 kw and the outflow aperture more than 800 mm, is larger, which is generally more than 10 t. When such large-scale submersible sewage pump is fixed on a side of the seat in a suspension way in the prior art, there are several disadvantages as follow:

1) The installation in a lateral suspension way certainly brings about increasing lateral torque to the seat, and the suspension unit is usually cast by the cast iron. The increasing volume and weight of the submersible sewage pump certainly will cause the inadequate strength of the suspension unit, and it leads the suspension unit to break, so that the whole submersible sewage pump can not work.
2) Because the bottom of the submersible sewage pump is suspending, shock caused by such a pump when working is increased, and thus it certainly will affect the normal running of the pump and there will be huge potential safe hazard.

SUMMARY OF THE INVENTION

The technical matters to be solved by the present invention is to provide a large-scale submersible sewage pump with a pump seat installation structure which could firmly fix and support the large-scale submersible sewage pump and avoid the potential safety hazard of the pump in operation.

The solution of the present invention is to provide a large-scale submersible sewage pump with the configuration as follow: it includes a pump and a pump seat installation structure. Said pump seat installation structure includes a concrete installation base layer, and a pump seat for installing the pump. Said pump seat is fixed to the pump installation layer. The bottom of said pump is directly connected to the pump seat.

With the structure mentioned-above, as compared to the art, the large-scale submersible sewage pump according to the present invention has the following advantages:

1) Because the bottom of said pump is directly connected to the pump seat and the pump seat is fixed on the pump installation layer, that is to say, the pump is firmly connected to the pump installation layer, the phenomenon of rupture of the suspension caused by the construction of the suspension type is avoided. Therefore, the occurring of the potential safe hazard of the pump in operation is avoided.
2) Because the pump seat is fixed to the pump installation layer so that there is no space between them, the shock caused by the pump in operation is absorbed by the pump installation layer, thereby ensuring the normal running of the pump.

As a further develop of the present invention, the fixed connection of said pump seat and the pump installation layer means that the pump installation structure also includes a steel plate I pre-embedded in the pump installation layer and a concrete enwrapping layer. Said pump seat is connected with the steel plate I, and the connection and outside of the pump seat are coated with a concrete enwrapping layer. After the pump seat with the construction of such concrete enwrapping layer, that is to say, the concrete structure, is employed, the connection of the pump and the pump installation layer is firmly enough and the difficulty of its production-manufacturing is less, thus decreasing the cost.

As a further develop of the present invention, the connection of said pump seat with the steel plate I means that the connection includes a locating pin and a briquetting. Said pump seat is consisted of a base plate and a surrounding wall. Said locating pin is spliced in the base plate of the pump seat, said briquetting is of converse L-shape. One end of the briquetting is welded with the steel plate I, and the other end of the briquetting is welded with the locating pin. Such a construction is employed, because the pump seat is generally of the large-scale volume and generally cast by the cast iron and the steel plate is ironwork which could not be welded together with the cast. So several locating pins spliced into said pump seat are welded on the steel plate, and then the steel plate is welded together with the locating pin by means of the briquetting, so that the pump seat is fixed on the steel plate. The construction is very simply and the operation is very convenience.

As a further develop of the present invention, an inlet end of the pump is located within the surrounding wall and the end face of the inlet end is abutted with the upper surface of the base plate. With this construction, because the pump and the outlet pipe is coaxial, that is to say, no torque generated by the pump transfers to the outlet pipe, so that the end face of the inlet end of the pump is pressed fitting with the upper surface of the base plate of the pump seat by means of the weight of the pump itself. The construction is very simply and further ensures the operation function of the pump.

As a further develop of the present invention, said pump includes a motor. Said motor includes a stator, a rotor and a shaft; said stator, rotor and shaft is fixed within the case of the motor; an internal cooling apparatus circularly cooled by a first coolant is provided in said motor case, and an external cooling apparatus circularly cooled by a second coolant is provided outside of said motor. Said internal cooling apparatus includes a motor cavity which is also regarded as the cooling cavity and some cooling pipes for the first coolant circularly passing, and the passage of said cooling pipe is communicated with the motor cavity while the pipe body of said cooling pipe is located within the cooling cavity of the external cooling apparatus. Because an internal cooling apparatus is provided within the motor case of the large-scale submersible sewage pump according to the present invention, an external cooling apparatus is provided outside of said motor, the passage of the cooling pipe is communicated with the motor cavity and the pipe body of the cooling pipe is provided within the cooling cavity of the external cooling apparatus, the first coolant could carry off the heat generated by the motor stator and the motor rotor when the first coolant circularly passes in the external cooling apparatus and the second coolant circularly passes in the external cooling apparatus, and the second coolant could carry off the heat of the first coolant in the cooling pipe and the heat of the motor outer wall when the first coolant is passing the cooling pipe, so that the heat generated by the motor could be radiated in time and the potential safe hazard, such as the burning-out of the motor, is eliminated.

As a further develop of the present invention, said internal cooling apparatus also includes an impeller; said impeller is fixed on the motor shaft and located under the rotor and stator of the motor; a spacer ring is provided on the periphery of said impeller, and several through holes are provided on the wall of said spacer ring; the upper end of said cooling pipe is communicated with the motor cavity in the upper end of said stator and rotor, and the lower end of said cooling pipe is communicated with the motor cavity in the lower end of said stator and rotor and located outside of the spacer ring. In such a construction, the internal cooling apparatus is structurally simple, and the impeller is fixed on the motor shaft and rotating synchronously with the motor shaft, so that the energy is utilized properly; a spacer ring is provided on the periphery of said impeller and causes the pressure difference between the inside and outside of the spacer, so that the first coolant is circulated in the motor cavity and passing the cooling pipe.

As another further develop of the present invention, said external cooling apparatus includes a cooling water jacket, an inlet pipe and an outlet pipe; said cooling water jacket is provided outside of the case; said inlet pipe is inserted into and communicated with the cooling cavity of said cooling water jacket and the highest end of said inlet pipe is bellow the lowest end of said stator and rotor; said outlet pipe is inserted into the cooling cavity of said cooling water jacket and the highest end of said outlet pipe is above the highest end of said stator and rotor. With this construction, the external cooling apparatus comprises a simple structure when cooling, the second coolant enters into the cooling cavity of the external cooling apparatus from the inlet pipe, and flows from the cooling cavity through the outlet pipe while carrying off the heat generated by the motor.

As a further develop of the present invention, it also includes a installation guide device; said installation guide device include two guide bars which are used for sliding fitting with said pump and guiding it when installing, and said two guide bars are located on both symmetrical sides of the scroll case of the pump, respectively. Because the two guide bar are respectively located on both symmetrical sides of the scroll case of the pump, the torque generated by the self-weight of the pump supported by the two guide bar is symmetrical and balanceable, so that the deformation of the guide bars is avoided, thereby ensuring the smooth insertion and withdrawal of the pump.

As a further develop of the present invention, the slippers are provided on both symmetrical sides of said scroll case, a groove is provided on each said slipper, and said two guide bars are sliding fitted with the groove on the slipper on both sides of the scroll case, respectively. With this construction, the fitting construction of the pump with the guide bar is more simple, the stress forcing on the slippers are balanceable, and the phenomenon of rupture is avoided, thereby ensuring the normal operation of the pump.

As a further develop of the present invention, said installation guide device further includes a steel plate II pre-embedded in the pump installation layer, and the bottom of each said guide bar is connected with the steel plate II. With this construction, the connection of the guide bars with the pump installation layer is firmer, and at the same time, the connection is more convenience and simpler.

wherein: 1 pump; 1.1 inlet end; 1.2 motor; 1.2.1 stator; 1.2.2 rotor; 1.2.3 shaft; 1.2.4 motor cavity; 1.2.5 impeller; 1.2.6 spacer ring; 1.2.7 cooling cavity; 1.2.8 cooling water jacket; 1.2.9 inlet pipe; 1.2.10 outlet pipe; 1.2.11 cooling cavity; 1.2.12 case; 2 pump seat; 2.1 base plate; 2.2 surround wall; 3 pump installation layer; 3.1 steel plate I; 3.2 concrete enwrapping layer; 3.3 the locating pin; 3.4 the briquetting; 3.5 the steel plate II; 4 the pump pool bottom; 5 the base station; 6 the guide bar

DETAILED DESCRIPTION OF THE INVENTION

In the following, the present invention will be further explained by means of the preferred embodiment with reference to the attached drawings.

Figure 1:
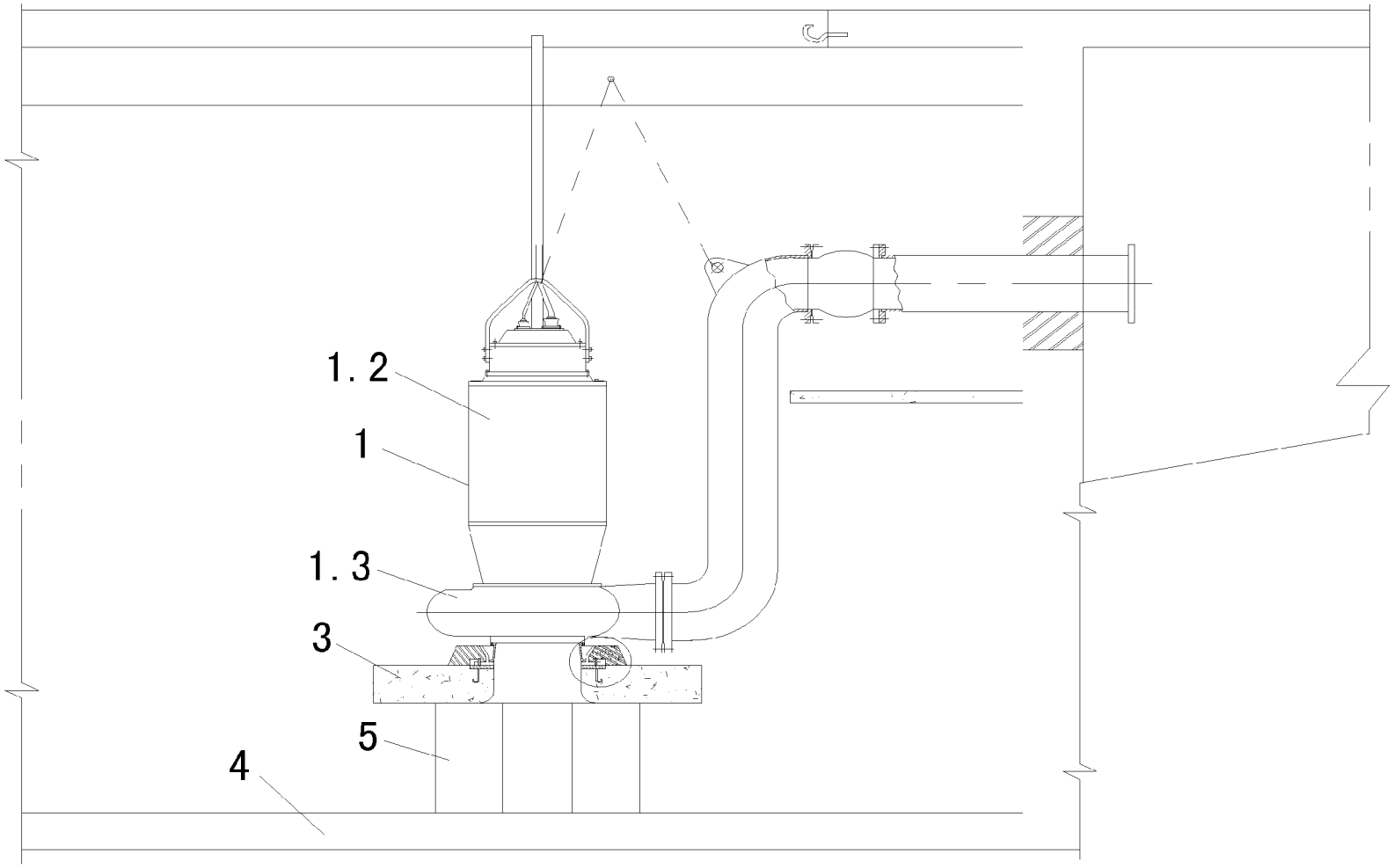
FIG. 1 is the structural representation view of the large-scale submersible is sewage pump according to the present invention.
Figure 2:
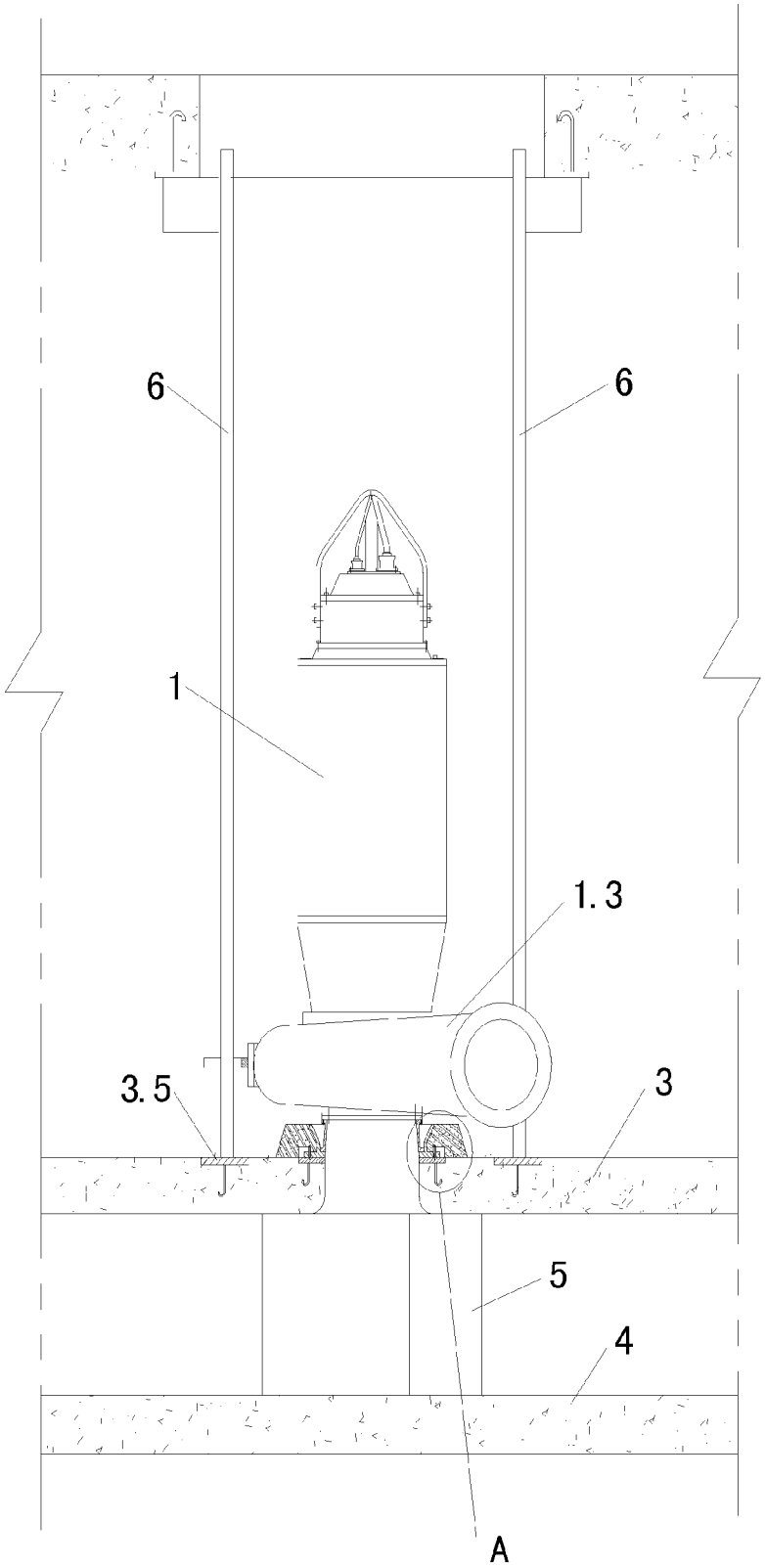
FIG. 2 is the structural representation view of the large-scale submersible sewage pump according to the present invention from another perspective.
Figure 3:
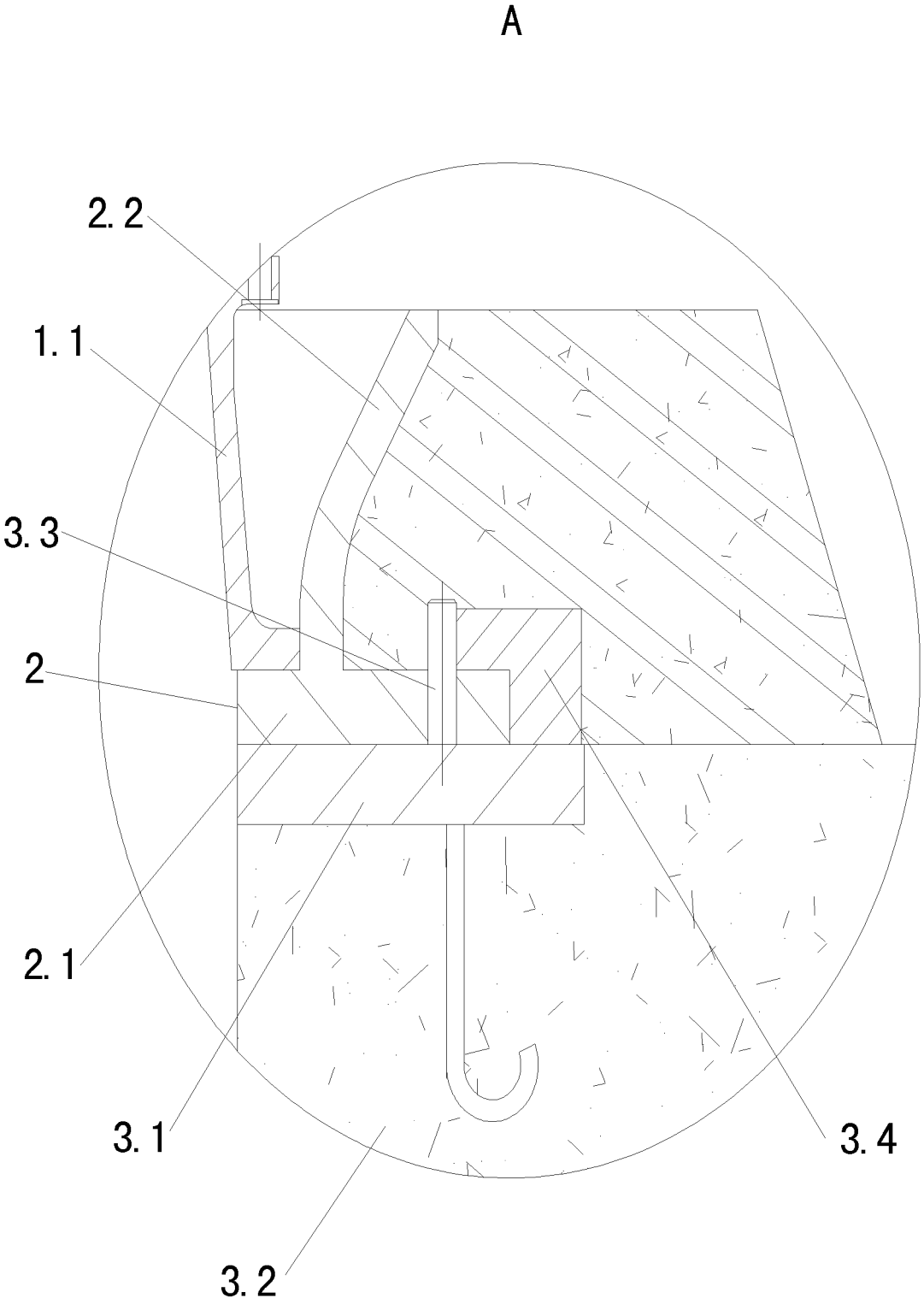
FIG. 3 is the enlarged structural representation view of the portion A in FIG. 2.

As shown in FIGS. 1, 2 and 3, the large-scale submersible sewage pump according to the present invention includes a pump 1 and a pump seat installation structure. Said pump seat installation structure includes a concrete pump installation base layer 3, a concrete pump pool bottom 4, and a pump seat 2 for installing the pump 1. Said pump installation layer 3 is located above the pump pool bottom 4, and firmly coupled with the pump pool bottom 4 by means of a concrete base station 5. Said pump seat 2 is firmly coupled with the pump installation layer 3, while the bottom of said pump 1 is directly connected onto the pump seat 2.

Said pump seat 2 is fixed to the pump installation layer 3, that is to say, the pump installation structure also includes a steel plate I 3.1 and a concrete enwrapping layer 3.2 pre-embedded in the pump installation layer 3. Said pump seat 2 is connected with the steel plate I 3.1, while the connection and outside of the pump seat 2 are coated with a concrete enwrapping layer 3.2.

Said pump seat 2 is connected with the steel plate I 3.1, that is to say, the connection includes a locating pin 3.3 and a briquetting 3.4. Said pump seat 2 is consisted of a base plate 2.1 and a surrounding wall 2.2. Said locating pin 3.3 is spliced in the base plate 2.1 of the pump seat 2, while said briquetting 3.4 is of the converse L-shape. An end of the briquetting 3.4 is welded with the steel plate I 3.1, while another end is welded with the locating pin 3.3. The inlet end 1.1 of the pump is located within the surrounding wall 2.2, and the end face of the inlet end 1.1 is abutted with the upper surface of the base plate 2.1. The free end of the surrounding wall 2.2 of said pump seat 2 is of the bell shape.

Figure 4:
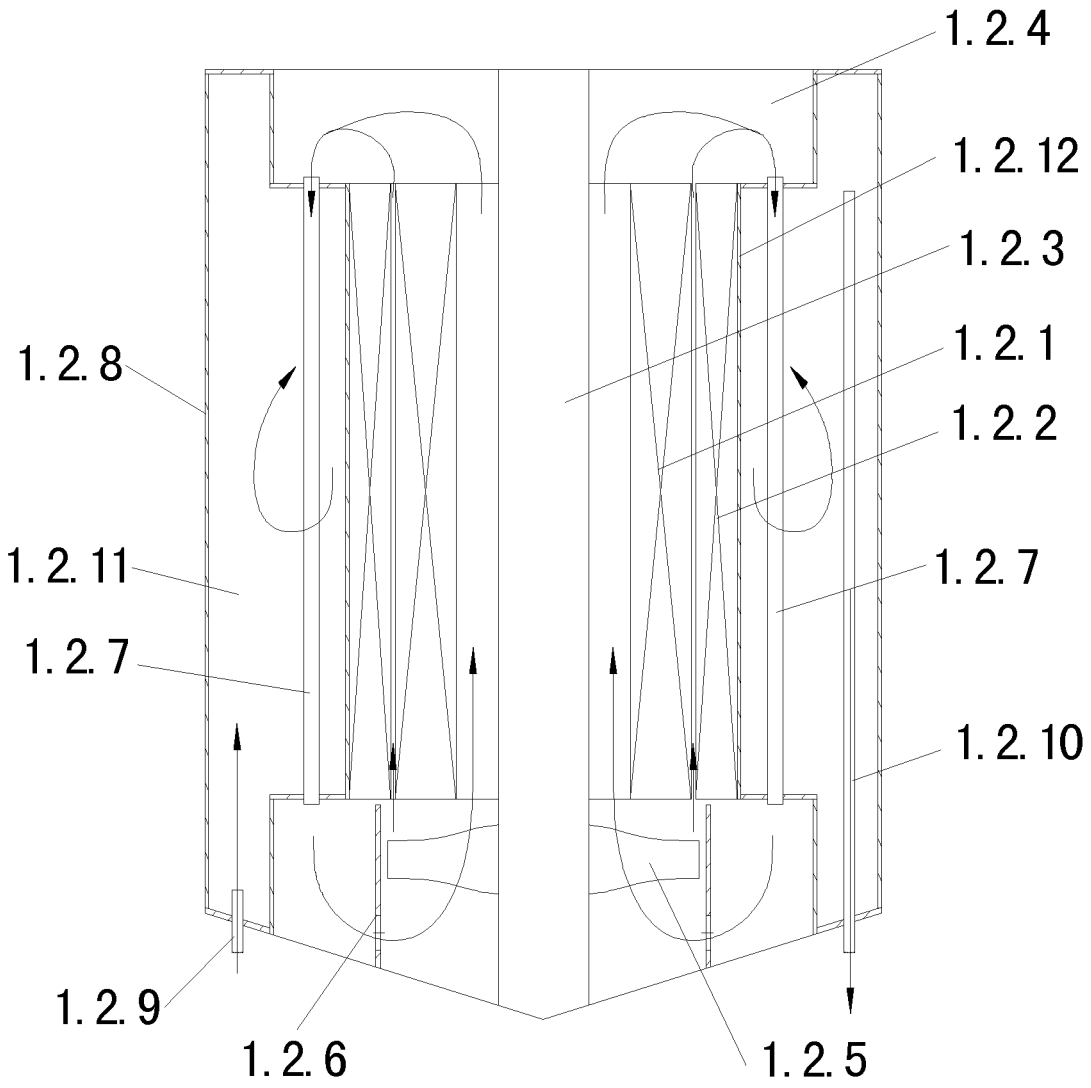
FIG. 4 is the inner structural representation view of the motor of the large-scale submersible sewage pump according to the present invention.

As shown in FIG. 4, said pump 1 includes a motor 1.2. Said motor 1.2 includes a stator 1.2.1, a rotor 1.2.2 and a shaft 1.2.3. Said stator 1.2.1, the rotor 1.2.2 and the shaft 1.2.3 is fixed within the case 1.2.12 of the motor 1.2. An internal cooling apparatus cooled circularly by a first coolant is provided within the casing 1.2.12 of the motor 1.2. An external cooling apparatus cooled circularly by a second coolant is provided outside of the motor 1.2. Said internal cooling apparatus includes a motor cavity 1.2.4 which is also regarded as the cooling cavity and some cooling pipes 1.2.7 for the first coolant circularly passing, and the passage of said cooling pipe 1.2.7 is communicated with the motor cavity 1.2.4 while the pipe body of said cooling pipe 1.2.7 is located within the cooling cavity 1.2.11 of the external cooling apparatus. The first coolant is the coolant oil, while the second coolant is the cooling water. Said the cooling pipe 1.2.7 is the steel pipe. Said motor cavity 1.2.4 includes the cavity above the stator 1.2.1 and the rotor 1.2.2, and the cavity under the stator 1.2.1 and the rotor 1.2.2.

Said internal cooling apparatus also includes an impeller 1.2.5. Said impeller 1.2.5 is fixed on the shaft 1.2.3 of the motor 1.2 and is located under the rotor 1.2.2 and the stator 1.2.1 of the motor 1.2. A spacer ring 1.2.6 is provided on the periphery of said impeller 1.2.5, and several through hole is provided on the wall of said spacer ring 1.2.6. The upper end of said cooling pipe is communicated with the motor cavity 1.2.4 at the upper end of said stator 1.2.1 and rotor 1.2.2, while the lower end of said cooling pipe 1.2.7 is communicated with the motor cavity at the lower end of said stator 1.2.1 and rotor 1.2.2 and located outside of the spacer ring 1.2.6.

Said external cooling apparatus includes a cooling water jacket 1.2.8, an inlet pipe 1.2.9 and an outlet pipe 1.2.10. Said cooling water jacket 1.2.8 is provided outside of the case 1.2.12. Said inlet pipe 1.2.9 is inserted into and communicated with the cooling cavity 1.2.11 of said cooling water jacket 1.2.8, and the highest end of the inlet pipe 1.2.9 is bellow the lowest end of said stator 1.2.1 and rotor 1.2.2. Said outlet pipe 1.2.10 is inserted into and communicated with the cooling cavity 1.2.11 of said cooling water jacket 1.2.8, and the highest end of said outlet pipe 1.2.10 is above the highest end of said stator 1.2.1 and rotor 1.2.2.

Figure 5:
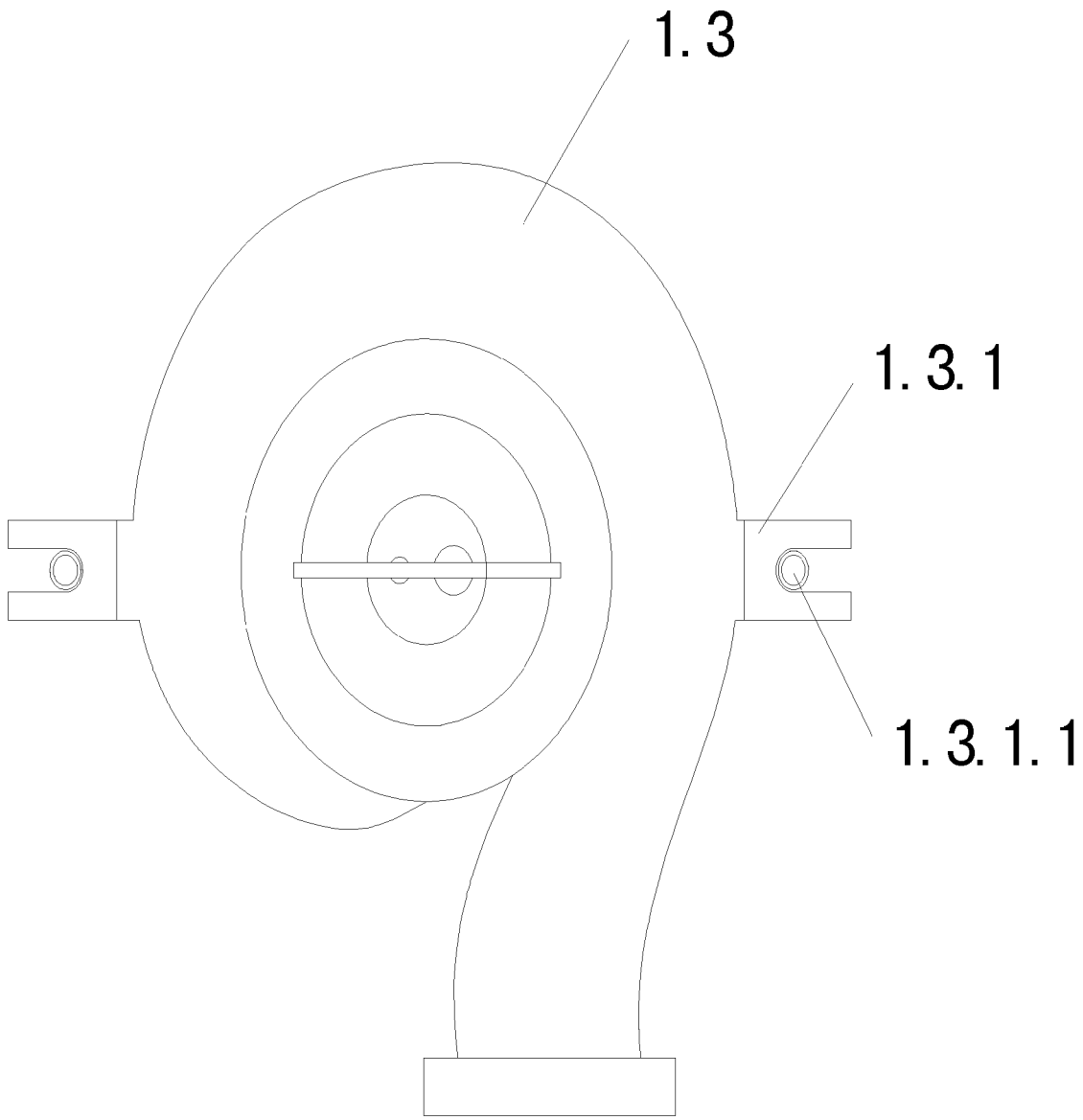
FIG. 5 is the partial top structural representation view of the large-scale submersible sewage pump according to the present invention.

As shown in FIG. 5, the large-scale submersible sewage pump according to the present invention further includes an installation guide device. Said installation guide device include two guide bars 6 which are used for sliding fitting with said pump 1 and guiding it when installation, and said two guide bars 6 are located on both symmetrical sides of the scroll case 1.3 of the pump 1, respectively.

A sipper 1.3.1 is provided on each of the symmetrical sides of said scroll case 1.3. Each of said slippers 1.3.1 has a groove 1.3.1.1 and said two guide bars 6 are sliding fitted with the grooves 1.3.1.1 of the slippers 1.3.1 on both sides of the scroll case 1.3 respectively. Said installation guide device further includes a steel plate II 3.5 pre-embedded in the pump installation layer 3, and the bottom of each guide bar 6 is connected with the steel plate II 3.5. In this embodiment, the connection is welding.

The invention claimed is:

1. A large-scale submersible sewage pump, comprising: a pump including a motor; and a pump installation structure including a pump installation layer with a concrete foundation and a pump seat for installing the pump, wherein said pump seat is firmly coupled with the pump installation layer, and a bottom of said pump is directly connected onto the pump seat; said motor includes a stator, a rotor and a shaft; said stator, rotor and shaft are fixed within a case of the motor; an internal cooling apparatus cooled by a first circulatory coolant, which is provided within the case of said motor, and an external cooling apparatus cooled by a second circulatory coolant which is provided outside the case of said motor; and said internal cooling apparatus includes a motor cavity which forms a first cooling cavity and a plurality of cooling pipes for the first circulatory coolant passing through the motor cavity, the cooling pipes are communicated with the motor cavity and said cooling pipes are provided within a second cooling cavity of the external cooling apparatus; said internal cooling apparatus includes an impeller fixed on the shaft of the motor and located under the rotor and the stator of the motor; a spacer ring is provided on a periphery of said impeller, and a plurality of through holes are provided on a wall of said spacer ring; an upper end of each said cooling pipe is communicated with the motor cavity at an upper end of the stator and the rotor; a lower end of each said cooling pipe is communicated with the motor cavity at a lower end of the stator and the rotor, and the lower end of each said cooling pipe is located outside the spacer ring; said external cooling apparatus includes a cooling water jacket, an inlet pipe and an outlet pipe: said cooling water jacket is provided outside the case; said inlet pipe is inserted into and communicated with a cooling cavity of said cooling water jacket, and a highest end of the inlet pipe is below a lowest end of the stator and the rotor; and said outlet pipe is inserted into and communicated with the cooling cavity of said cooling water jacket and a highest end of said outlet pipe is above a highest end of the stator and the rotor.

2. The large-scale submersible sewage pump as clamed in claim 1, wherein the pump installation structure includes a first steel plate pre-embedded in the pump installation layer and a concrete enwrapping layer:

said pump seat is connected with the first steel plate; and the connection of the pump seat with the first steel plate and an outside of the pump seat are coated by the concrete enwrapping layer.

3. The large-scale submersible sewage pump as claimed in claim 2, wherein the connection of said pump seat with the first steel plate includes a locating pin and a block;

said pump seat includes a base plate and a surrounding wall;

said locating pin is integrated with the base plate of the pump seat; and said block is of an L-shape, one end of the block is welded with the first plate and the other end is welded with the locating pin.

4. The large-scale submersible sewage pump as claimed in claim 3, wherein an inlet end of the pump is located within the surrounding wall; and an end face of the inlet end is abutted with an upper surface of the base plate.

5. The large-scale submersible sewage pump as claimed in claim 1, further comprising:

an installation guide device including two guide bars for sliding and guiding said pump during installation, wherein said two guide bars are located on both symmetrical sides of a scroll case of the pump, respectively.

6. The large-scale submersible sewage pump as claimed in claim 5, wherein a slipper is provided on each of the symmetrical sides of said scroll case, each said slipper has a groove and said two guide bars are slidable within the grooves of the slippers on both said symmetrical sides of the scroll case, respectively.

7. The large-scale submersible sewage pump as claimed in claim 6, wherein said installation guide device further includes a second steel plate pre-embedded in the pump installation layer, and the bottom of each said guide bar is connected with the second steel plate.

* * * * *